US010431935B2

(12) United States Patent
Huang et al.

(10) Patent No.: US 10,431,935 B2
(45) Date of Patent: Oct. 1, 2019

(54) CONNECTOR

(71) Applicant: SPEED TECH CORP., Taoyuan (TW)

(72) Inventors: Kuo-Hua Huang, Taoyuan (TW); Cheng-Hsiang Hsueh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 16/125,790

(22) Filed: Sep. 10, 2018

(65) Prior Publication Data

US 2019/0006794 A1 Jan. 3, 2019

Related U.S. Application Data

(63) Continuation of application No. 15/628,632, filed on Jun. 20, 2017, now Pat. No. 10,096,944.

(30) Foreign Application Priority Data

Jan. 23, 2017 (TW) ..... 106201345 U

(51) Int. Cl.

| | |
|---|---|
| ***H01R 13/64*** | (2006.01) |
| ***H01R 13/6466*** | (2011.01) |
| ***H01R 13/6582*** | (2011.01) |
| ***H01R 13/422*** | (2006.01) |
| ***H01R 13/26*** | (2006.01) |
| ***H01R 12/00*** | (2006.01) |
| *H01R 12/72* | (2011.01) |
| *H01R 24/60* | (2011.01) |

(52) U.S. Cl.

CPC ..... *H01R 13/6466* (2013.01); *H01R 12/00* (2013.01); *H01R 13/26* (2013.01); *H01R 13/4226* (2013.01); *H01R 13/64* (2013.01); *H01R 13/6582* (2013.01); *H01R 12/721* (2013.01); *H01R 24/60* (2013.01)

(58) Field of Classification Search

CPC ..... H01R 13/6275; H01R 13/6658

See application file for complete search history.

(56) References Cited

U.S. PATENT DOCUMENTS

| | | | |
|---|---|---|---|
| 7,175,444 | B2 | 2/2007 | Lang et al. |
| 7,189,098 | B1 | 3/2007 | Wu |

(Continued)

FOREIGN PATENT DOCUMENTS

| | | | |
|---|---|---|---|
| CN | 2699521 | Y | 5/2005 |
| CN | 2728025 | Y | 9/2005 |

(Continued)

*Primary Examiner* — Ross N Gushi

(74) *Attorney, Agent, or Firm* — CKC & Partners Co., LLC

(57) ABSTRACT

A connector includes an insulating housing, a circuit board, a flexible piece, and a plurality of guide rods. The circuit board has a front end configured to dock with a docking connector, a back end distal to the front end, and a plurality of gold fingers disposed at the front end. The back end is embedded in the insulating housing and the front end is extended outwardly from the insulating housing such that each gold finger is exposed at a surface of the circuit board. The flexible piece is installed at a top surface of the insulating housing. The flexible piece is used to engage with the docking connector. Each gold finger can be electrically connected to the docking connector. Each guide rod is disposed at two opposite sides of the insulating housing. Each guide rod extends outwardly towards the docking connector.

18 Claims, 12 Drawing Sheets

(56) References Cited

U.S. PATENT DOCUMENTS

| | | | | |
|---|---|---|---|---|
| 7,226,314 | B2 | 6/2007 | Lang et al. | |
| 7,232,329 | B1 | 6/2007 | Wu | |
| 7,261,582 | B2 | 8/2007 | Wu | |
| 7,267,575 | B1 | 9/2007 | Hwang | |
| 7,291,034 | B2 | 11/2007 | Wu | |
| 7,303,438 | B2 | 12/2007 | Dawiedczyk et al. | |
| 7,344,409 | B2 | 3/2008 | Lang et al. | |
| 7,410,365 | B2 | 8/2008 | Wu | |
| 7,448,897 | B2 | 11/2008 | Dawiedczyk et al. | |
| 7,491,089 | B2 | 2/2009 | Lang et al. | |
| 7,601,010 | B1 | 10/2009 | Wu | |
| 7,798,821 | B2 | 9/2010 | Liu et al. | |
| 7,857,650 | B1 | 12/2010 | Wu | |
| 7,891,986 | B2 | 2/2011 | Wu | |
| 7,909,661 | B2 | 3/2011 | Wu | |
| 7,997,909 | B2 | 8/2011 | Xu et al. | |
| 8,454,381 | B2 | 6/2013 | Wu et al. | |
| 2006/0160399 | A1 | 7/2006 | Dawiedczyk et al. | |
| 2012/0156938 | A1* | 6/2012 | Zhang ..... | H01R 13/6461 439/660 |
| 2012/0184126 | A1 | 7/2012 | Chen et al. | |

FOREIGN PATENT DOCUMENTS

| | | | |
|---|---|---|---|
| CN | 202076461 | U | 12/2011 |
| CN | 203026692 | U | 6/2013 |
| CN | 103633488 | A | 3/2014 |
| CN | 205429310 | U | 8/2016 |
| CN | 205811129 | U | 12/2016 |
| CN | 206789805 | U | 12/2017 |
| TW | M412483 | U | 9/2011 |
| TW | M427693 | U | 4/2012 |

* cited by examiner

CONNECTOR

RELATED APPLICATIONS

This application is a continuation of U.S. application Ser. No. 15/628,632, filed Jun. 20, 2017, which claims priority to Taiwan Application Serial Number 106201345, filed Jan. 23, 2017, which is herein incorporated by reference.

BACKGROUND

Technical Field

The present invention relates to a connector including a scoop-proof device and more particular to a connector includes a SAS (Serial Attached SCSI) transmission interface.

Description of Related Art

With the rapid change of science and technology in the recent years and the high speed progression of cloud technology, there follows a great amount of data to be transported. Using connectors to achieve the data transportation has already become an indispensable and crucial technology at the time. From the early SCSI (Small Computer System interface) to the nowadays SAS (Serial Attached SCSI, serial-SCSI), with respect to the need of high speed data accessing, serial technology overcomes the bottleneck of conventional parallel technology, and provides a much faster signal transportation functionality. Also, SAS is able to support and is compactable with the SATA (Serial Advanced Technology Attachment) device, which indicates the advantageous wide ranging compatibility of the SAS.

When connectors are docked together, if the structures of the plug and socket are not designed with a suitable position guiding device, it might be impossible to precisely insert the circuit board of the plug into the cavity of the socket, or there might be an excessive angle. In the case that the plug docks obliquely with the socket instead of in a straight line facing towards each other, the terminals of the socket may become easily extruded into deformation or bended recession. Not only the situation increases the time requirement of docking, but the general structure of the plug or the socket might also be damaged.

As shown in FIG. 12, to overcome the mismatch issue that the connector inserted obliquely into the socket during the docking phase of the plug and the socket, the Taiwan Pat. No. M412483 discloses a wire connector A100, including a docking circuit A1, a plurality of guide lines A2 electrically connected to the docking circuit A1, an insulating body A3 disposed at the periphery of the docking circuit A1 and the guide lines A2, and an engaging member A4 installed on the insulating body A3. A scoop-proof flange A31 is disposed on the top surface of insulating body A3 and the scoop-proof flange A31 has a front end A313 and a back end A311. The front end A313 of the scoop-proof flange A31 is disposed in a non-symmetry form respect to the insulating body A3. A guide surface A35 is disposed at a front end of one side of the scoop-proof flange A31, and a right angle terminal edge A36 is disposed at a front end of the other side of the scoop-proof flange A31.

When the wire connector A100 is docked with a socket connector (not shown), the wire connector A100 will be guided by the guide surface A35 such that the wire connector A100 may be docked with the socket connector. The wire connector A100 can be guided to a correct position by the structure design of the guide surface A35 so as to make the wire connector A100 be docked with the socket connector successfully. In the aforementioned way, the time wasted to dock the socket connector with the wire connector A100 is greatly reduced, and the structure damages due to the mismatch of the socket connector and the wire connector A100 can be prevented.

In the foregoing technology, however, the wire connector A100 is guided by only one structure on the guide surface A35, so the accuracy of guiding and matching has not yet achieved a satisfying level. Most designation of size specification of two docking structures do not strictly cooperate with each other, as there is a buffer space preserved to make sure that the errors generated in the manufacturing process will not further result in a docking failure or over-tightness. Accordingly, the wire connector A100 may be obliquely docked with the socket connector (not shown), so the mismatch issue during the docking phase is not entirely solved by the wire connector A100 and the socket connector. There still exists the problem that the socket connector may be docked with the wire connector A100 with an excessive angle, in which case the inside terminals of the socket connector are prone to be damaged by the bumping of the wire connector A100, and thus further reduces the life-span of the connector A100.

Since the prior art is unable to provide an adequate method to prevent the inside terminals of the socket connector from being recessed or being extruded by external forces, an improved technical solution to overcome the difficulty to satisfy the practical demand in the industry is in a desperate need.

SUMMARY

The invention provides a connector. The connector includes a scoop-proof device. When the connector docks with another connector, the scoop-proof device can effectively prevent the connector from being inserted with an offset angle, thus avoiding the inner-structure damage generated in the docking phase of the two connectors.

According to another aspect of the present invention, a connector is provided. The connector includes a scoop-proof device which is one or more guide rods. When the connector is going to share high frequency signals with the docking connector, the guide rods can guide the connector and the docking connecter to face each other and to be docked straightly. By reducing the occasions that connectors are docked with each other obliquely, the inside terminals are not bumped and damaged as often, thus generally improving the docking quality of the connectors.

To achieve the aforementioned purpose, a connector is provided in the present invention. The connector includes an insulating housing, a circuit board, and a plurality of guide rods. The circuit board has a front end configured to dock with a docking connector and a back end distal to the front end. A plurality of gold fingers is disposed at the front end and exposed at a surface of the circuit board. The back end is embedded in the insulating housing. The front end extends out of the insulating housing. Each of the guide rods is partially embedded in the insulating housing and parallel to the circuit board, wherein each of the guide rods is disposed at one of opposite sides of the insulating housing and extends outwardly towards the docking connector. Each of the gold fingers may be electrically connected to the docking connector. Wherein, each of the opposite sides of the insulating housing is disposed with at least one bump extending outwardly, and each of the guide rods is partially embedded in a side of a corresponding one of the bumps. Each of the guide rods is partially embedded in the insulating housing. The embedding method may be an insert molding method that inserts and molds each guide rod at a corresponding one of the bumps and a corresponding one of the insulating housing. In addition, each of the guide rods is a rectangular bar made of a metal material, and a side surface of each of the guide rods adjacent to the circuit board has an unfilled corner for the convenience of the inserting and molding of the guide rods into the bumps.

In the present invention, each of the guide rods has an exposed part exposed from the insulating housing, and the exposed part of each of the guide rods extends outwardly towards the docking connector and approach a location of the gold fingers on the circuit board, so as to form the guide rods as a scoop-proof device. The connector and the docking connector are docked together by the guidance of the guide rods located at the two sides of the insulating housing, so as to prevent the connector from docking with the docking connector with an offset angle. In addition, the guide rods may also be formed by vertically extending the two sides of the insulating housing of the connector outwardly towards the docking connector, so that the guide rods and the insulating housing are formed in one piece, thus generally improves the stability of the guide rods on the connector.

In the present invention, a flexible piece and a plurality of wires are disposed at the connector. The flexible piece is installed at the top surface of the insulating housing. The flexible piece is used to engage with the docking connector. Each of the wires is electrically connected to the circuit board. Each of the wires is embedded in the insulating housing. The embedding method may be an insert molding method which inserts and molds each of the wires into the insulating housing. A fixing slot is disposed at the top surface of the insulating housing and the flexible piece is accommodated and installed in the fixing slot. At least one engaging part is disposed at the flexible piece and the engaging part is used to engage with the docking connector.

It is to be understood that both the foregoing general description and the following detailed description are by examples, and are intended to provide further explanation of the invention as claimed instead of limiting the scope of the present invention.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
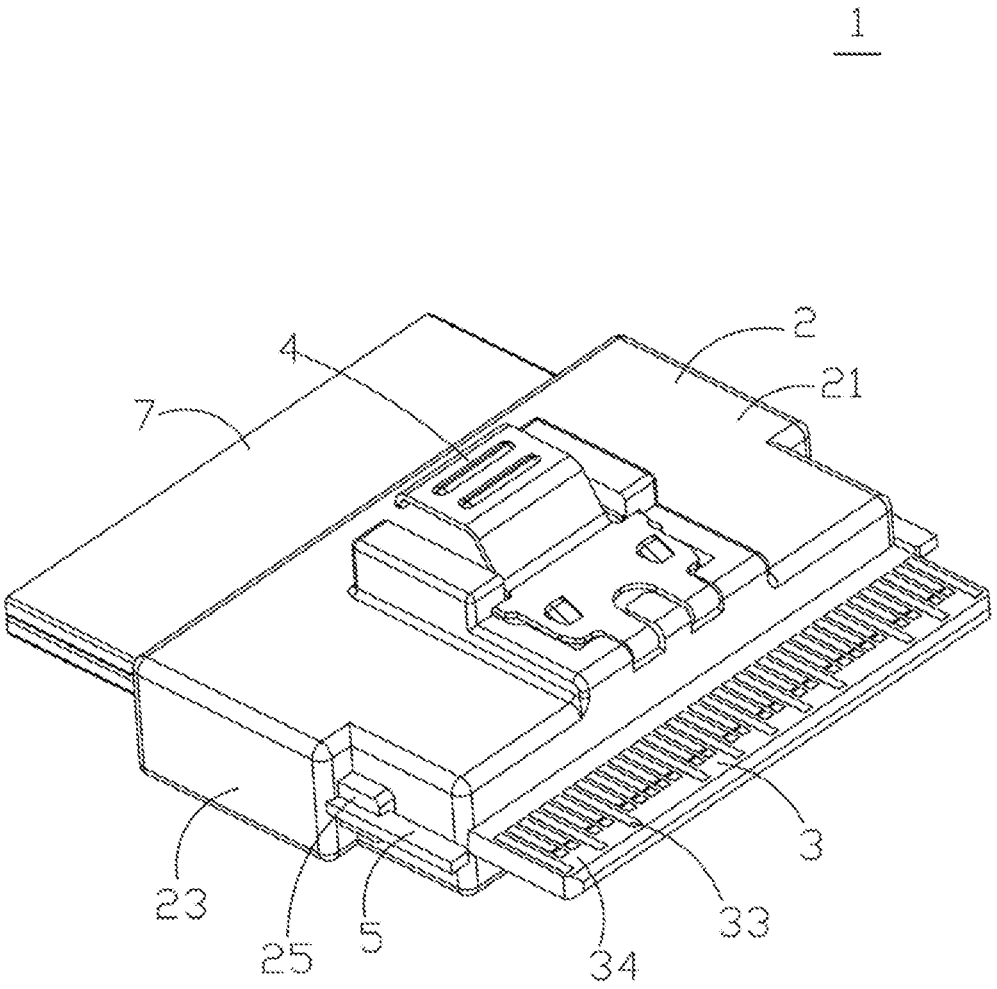
FIG. 1 is a three-dimensional view in a first perspective according to a first embodiment of the present invention.
Figure 2:
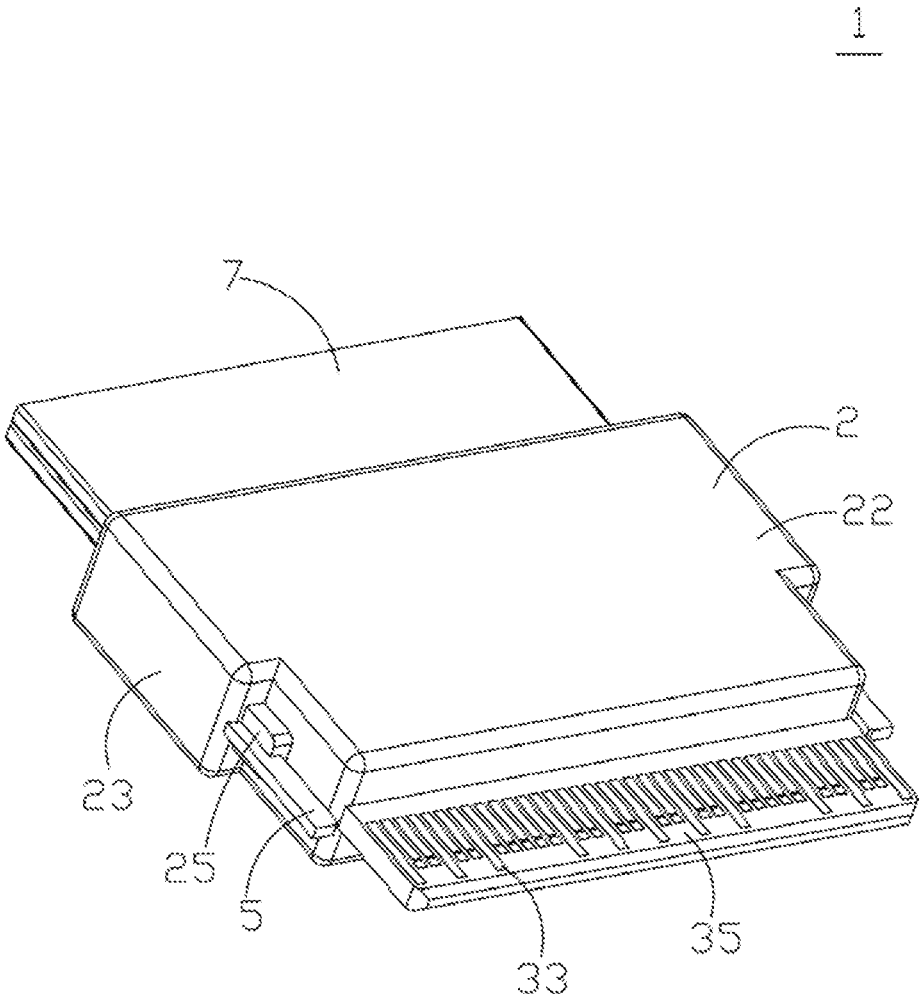
FIG. 2 is a three-dimensional view in a second perspective according to the first embodiment of the present invention.
Figure 3:
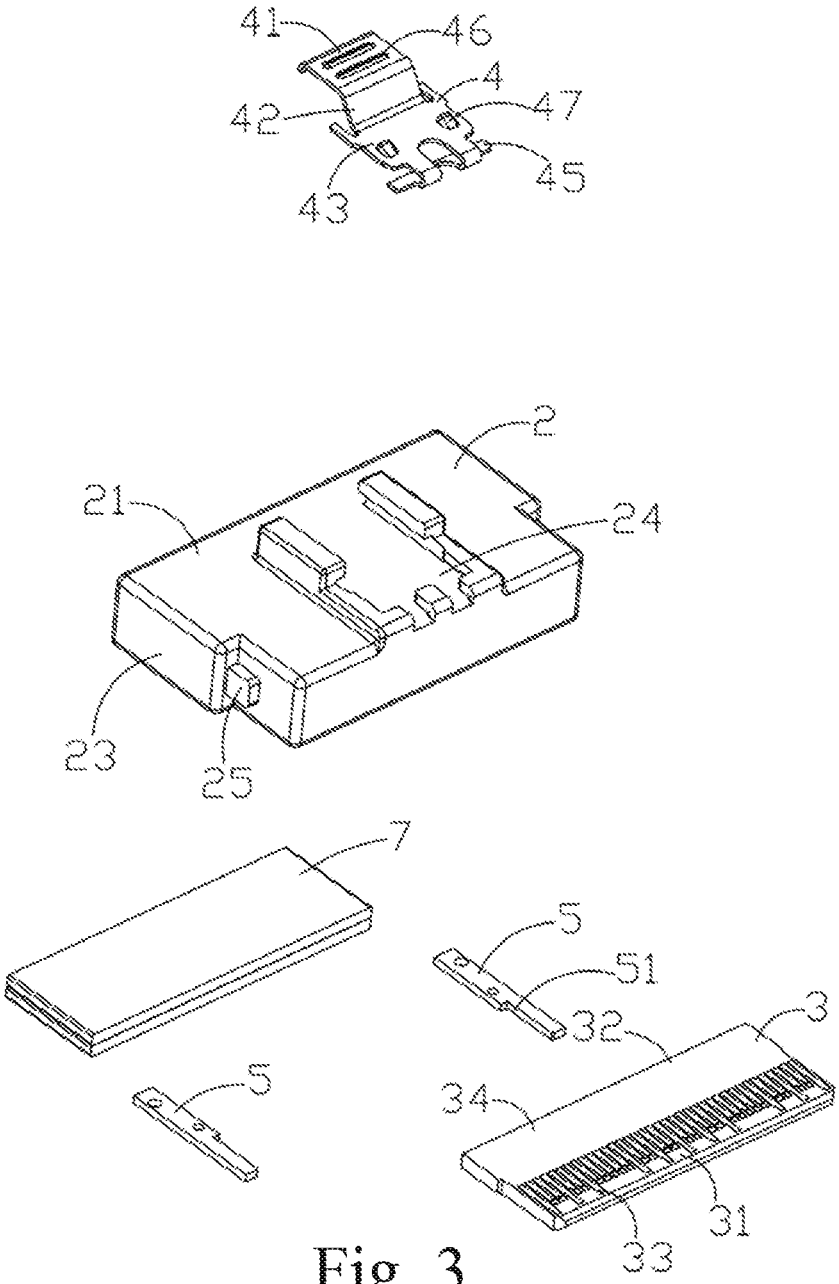
FIG. 3 is a three-dimensional exploded view in the first perspective according to the first embodiment of the present invention.
Figure 4:
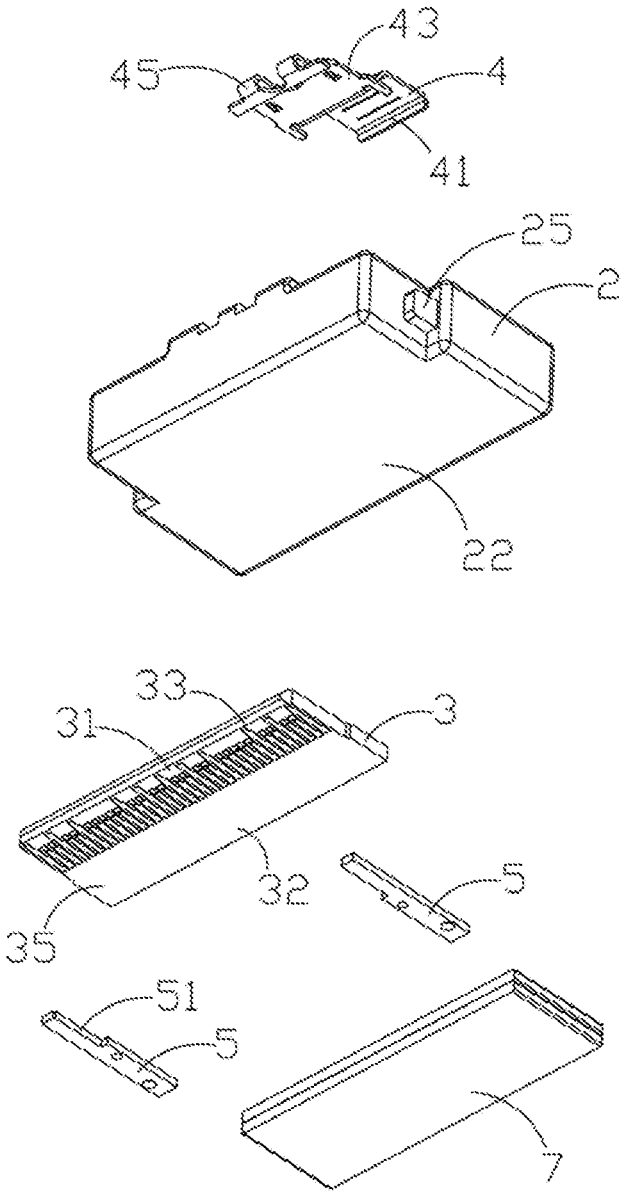
FIG. 4 is a three-dimensional exploded view in the second perspective according to the first embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 6:
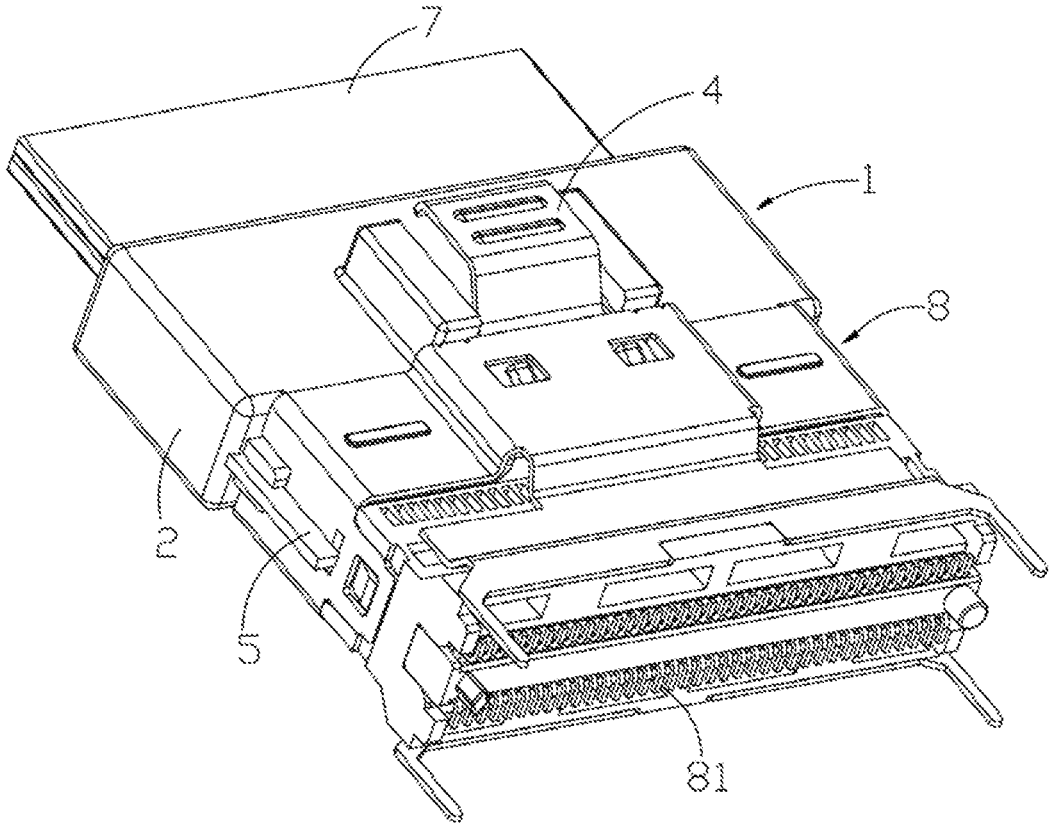
FIG. 6 is an appearance view of the first embodiment of the present invention with a docking connector.
Figure 7:
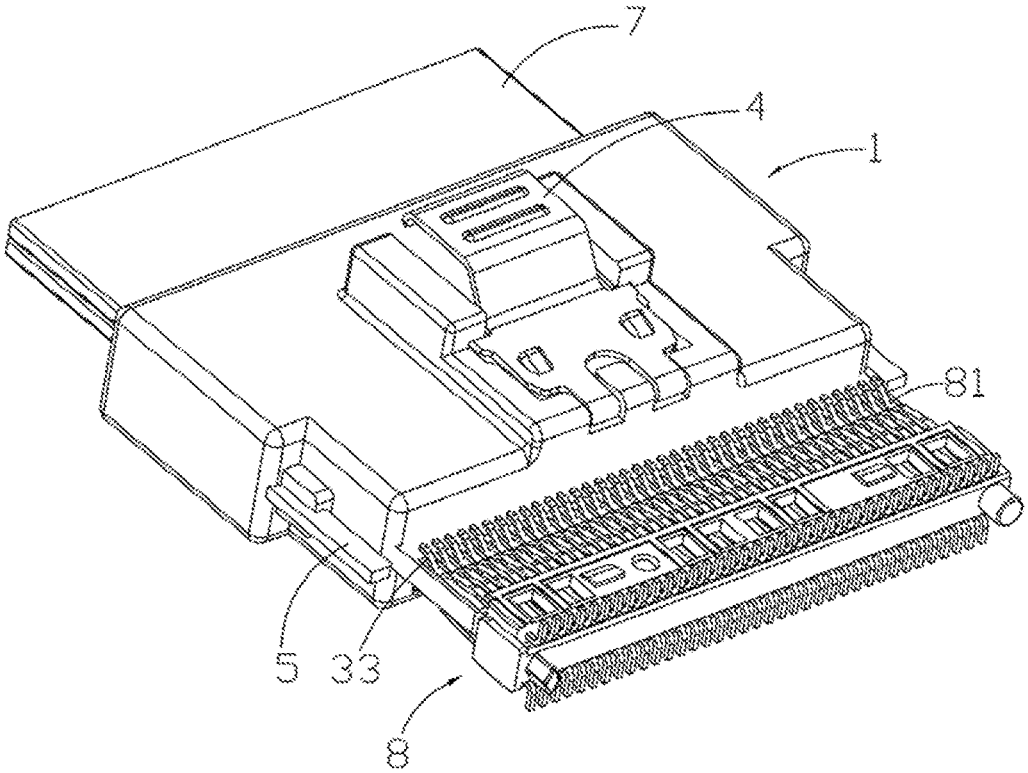
FIG. 7 is a schematic view of the first embodiment of the present invention with docking terminals of the docking connector.

As shown in FIG. 1 and FIG. 6, a connector is disclosed according to a first embodiment of the present disclosure. The connector 1 includes an insulating housing 2, a circuit board 3, and a plurality of first guides 5, wherein the circuit board 3 is extended from the insulating housing 2 and a docking connector 8 may be inserted in the connector 1. In particular, the circuit board 3 is embedded in the insulating housing 2.

As shown in FIG. 2 to FIG. 7, in the first embodiment of the present disclosure, the connector 1 includes an insulating housing 2, a circuit board 3, a flexible piece 4, and a plurality of first guide rods 5. The insulating housing 2 is made of an insulating material and the insulating housing 2 includes a top surface 21, a bottom surface 22, and a plurality of sides 23. Each of the sides 23 respectively connects to the top surface 21 and the bottom surface 22 to form a closed rectangular house. The circuit board 3 is also made of an insulating material. The circuit board 3 has a front end 31, a back end 32 and a plurality of gold fingers 33, wherein the front end 31 is configured to dock with a docking connector 8, the back end 32 is distal to the front end 31, and the gold fingers 33 is disposed at the front end 31 of the circuit board 3. An upper side of the circuit board 3 is defined as an upper surface 34 and a lower side of the circuit board is defined as a lower surface 35, wherein the upper surface 34 and lower surface 35 are non-adjacent and opposite to each other. A plurality of the gold fingers 33 are affixed to the upper surface 34 and the lower surface 35 of the circuit board 3. The back end 32 of the circuit board 3 is embedded in the insulating housing 2, the embedding method may be an insert molding method, which inserts and molds the circuit boards 3 through the insulating housing 2, for those skilled in the art may adopt an engage assembling method as another embedding method. The insulating housing 2 extends away from the front end 31 of the circuit board 3 such that each of the gold fingers 33 is exposed at the upper surface 34 and the lower surface 35 of the circuit board 3. When the circuit board 3 is docked with the docking connector 8, each of the gold fingers 33 may be electrically connected to the docking terminals 81 of the docking connector 8.

As shown in FIG. 1 to FIG. 7, in the first embodiment of the present invention, a flexible piece 4 is installed at the top surface 21 of the insulating housing 2. The flexible piece 4 is used to engage with the docking connector 8. The flexible piece 4 is a sectional structure formed by a bended metal slice. The flexible piece 4 may be produced by methods such as stamping, cutting and bending etc. The flexible piece 4 includes a press portion 41, a slope 42, a flat panel 43, and at least one engage part 45. One end of the slope 42 is connected to the press portion 41 and the other end of the slope 42 is connected to the flat panel 43. The press portion 41 includes two long flanges 46. The shape of the long flange 46 is designed for the convenience of users that the long flange 46 is directly pressed by an applied force. The disposition location and the configuration of the press portion 41 may be varied for practical demands. The figures disclosed in the present invention are only used to illustrate some preferred embodiments but not to limit the scope of the designation of the present invention. There is at least one engage part 47 disposed at the flat panel 43, and the engage part 47 is used to engage with the docking connector 8, wherein a fixing slot 24 is disposed at the top surface 21 of the insulating housing 2. The flat panel 43 and the engage part 45 are mounted in the fixing slot 24.

As shown in FIG. 1 to FIG. 7, in the first embodiment of the present disclosure, each of the first guide rods 5 is disposed at one of the opposite sides of the insulating housing 2, and each of the first guide rods 5 extends outwardly towards the docking connector 8. Each of the first guide rods 5 is parallel to the circuit board 3. Wherein each side of the insulating housing 2 is disposed with at least one bump 25 which extends outwardly, each of the first guide rods 5 is partially embedded in a side of the bumps 25, and each of the first guide rods 5 is partially embedded in the insulating housing 2. The embedding method may be an insert molding method, by which each of the first guide rods 5 is partially inserted and molded at each side of the bump 25 and the insulating housing 2. For those skilled in the art may adopt an engage assembling method as an alternative to insert molding method. Use the bump 25 to form a first remain gap 26 between each first guide rod 5 and the insulating housing 2. The first remain gap 26 can provide a tolerance of mismatching for the corresponding first guide rod 5, thus increases the adjusting flexibility of the first guide rod 5 during the assembling phase. In addition, each first guide rod 5 may be a rectangular bar made of a metal material such as Cu, Fe, or stainless steel, and any other suitable materials. For those skilled in the art may also adopt other metal materials as another manufacturing method. In addition, each first guide rod 5 has a side adjacent to the circuit board 3, and the side has an unfilled corner 51. The structure of the unfilled corner 51 is designed for the docking specification of the first guide rods 5 and the bumps 25, such that the first guide rods 5 can be easily inserted and molded to the bumps 25.

Figure 5:
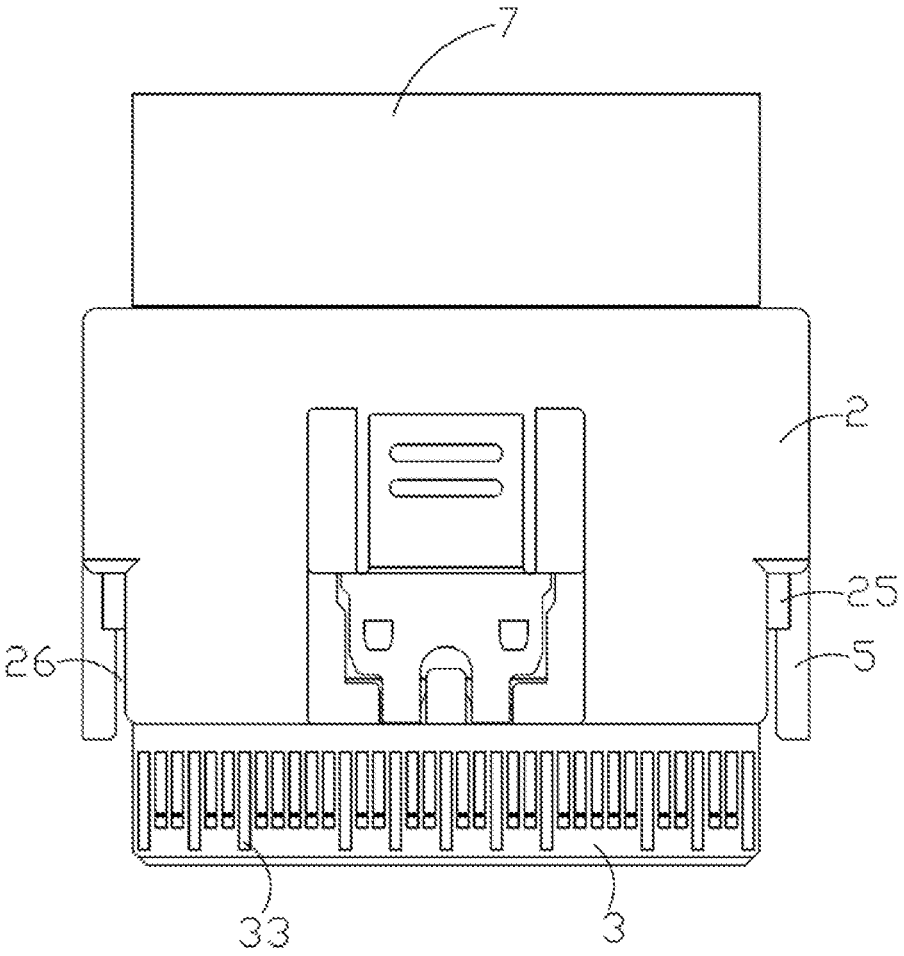
FIG. 5 is a schematic top view according to the first embodiment of the present invention.
Figure 8:
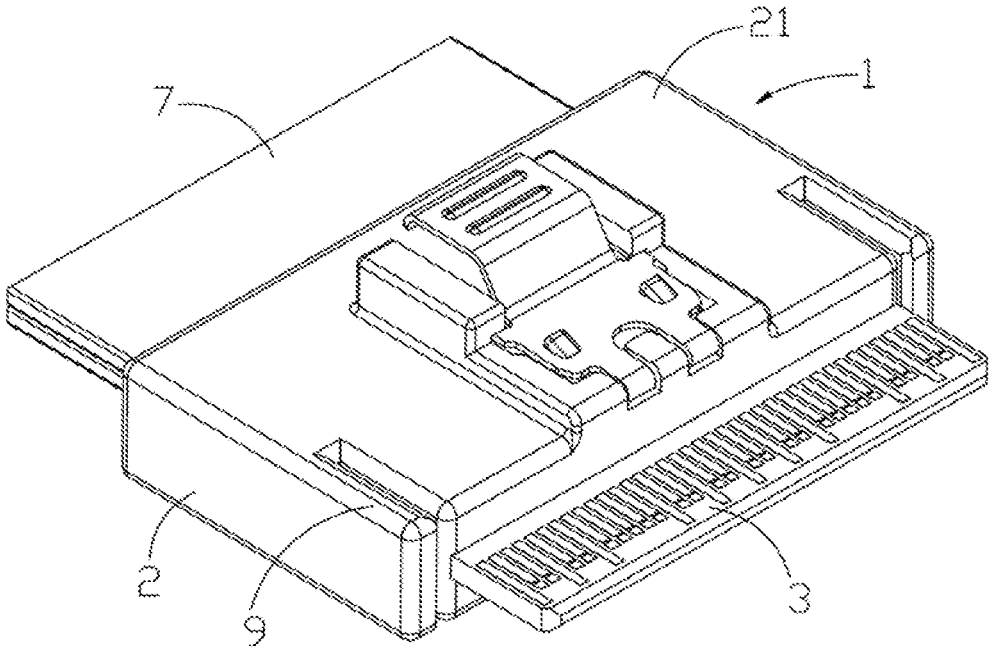
FIG. 8 is a three-dimensional view in the first perspective according to a second embodiment of the present invention.

As shown in FIG. 1 to FIG. 7, in the first embodiment of the present invention, a part of each first guide rod 5 is exposed out of the insulating housing 2. The exposed part of each first guide rod 5 extends outwardly towards the docking connector 8 and approaches to a location of the gold fingers 33 on the circuit board 3. In particular, as shown in FIG. 5, an end of the insulating housing 2 is connected to the circuit board 3, and the guides 5 extend beyond the end in the present embodiment. In other embodiments, the guides 5 may extend approximately to align with the end of the insulating housing 2, such as the guides 9 shown in FIG. 8 or 9. The first guide rods 5 located at the opposite sides of the bumps 25 of the insulating housing 2 is configured symmetrically that the first guide rods 5 may be formed as an scoop-proof device. The first guide rods 5 located at the opposite sides of the insulating housing 2 guide the connector 1 to dock with the docking connector 8, so as to prevent the docking connector 8 from docking with the connector 1 with an offset angle. In other words, not until the connector 1 and the docking connector 8 face towards each other in a straight line will the two be able to dock with each other. In the aforementioned way, this method can effectively prevent the docking terminals 81 of the docking connector 8 from being damaged by inappropriate external forces.

As shown in FIG. 1 to FIG. 7, In the first embodiment of the present disclosure, a plurality of wires 7 are disposed at the connector 1. Each of the wires 7 is electrically connected to the circuit board 3. Each of the wires 7 is embedded In the insulating housing 2. The embedding method may be an insert molding method, each of the wires 7 is inserted and molded in the insulating housing 2. Each of the wires 7 is arranged in two rows herein. The arrangement of the wires 7 may be varied for practical demand, the figures disclosed in the present invention is only a preferred embodiment.

Figure 9:
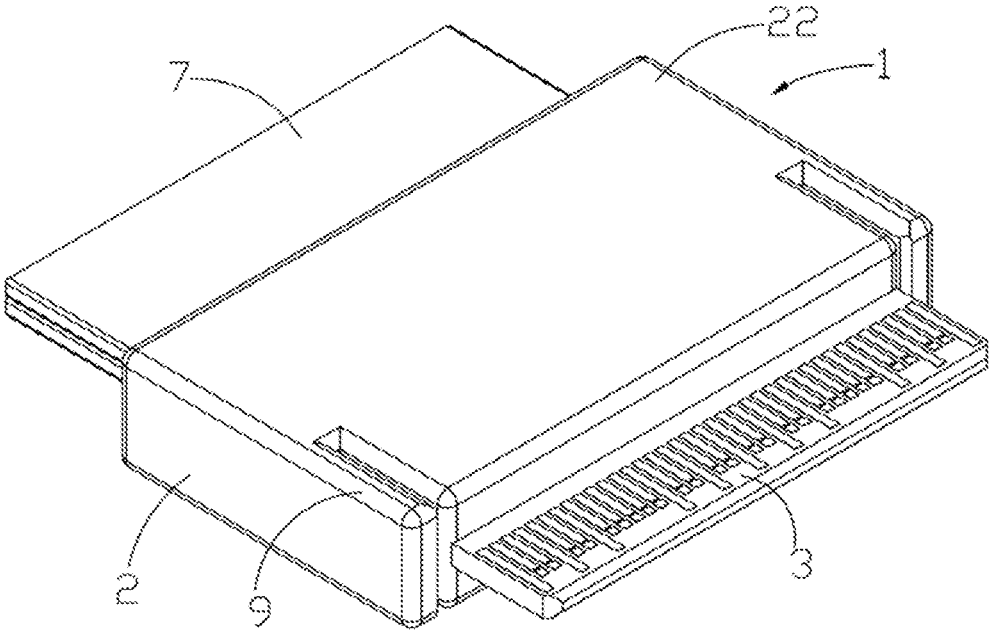
FIG. 9 is a three-dimensional view in the second perspective according to the second embodiment of the present invention.
Figure 10:
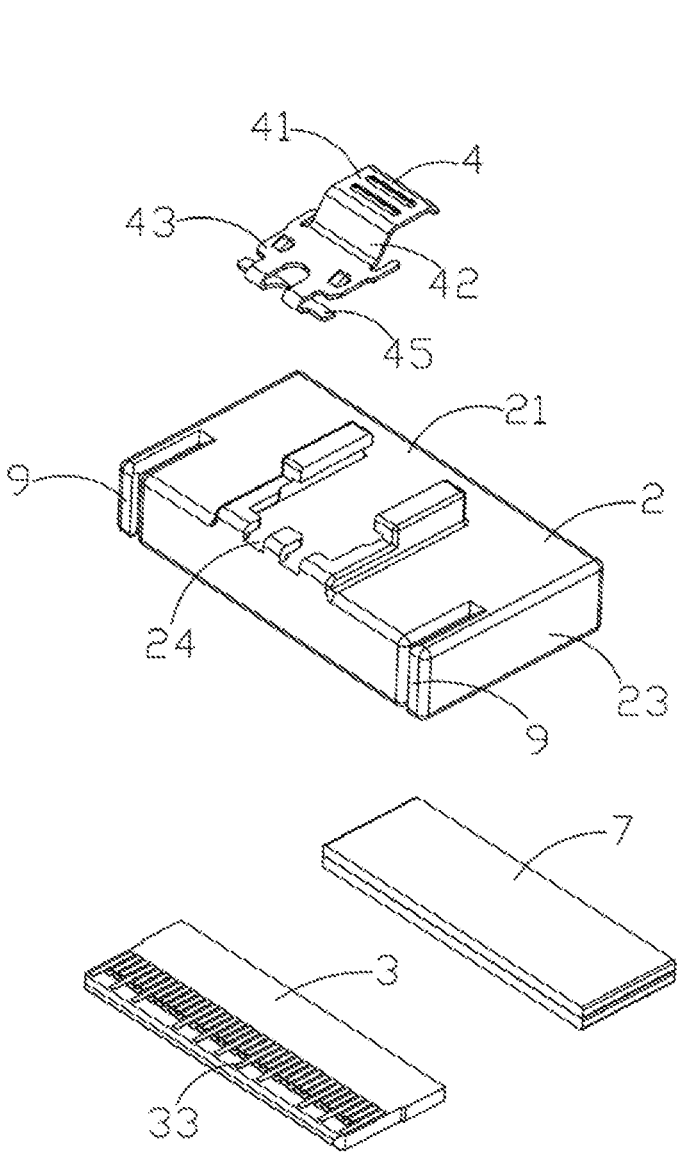
FIG. 10 is a three-dimensional exploded view in the first perspective according to the second embodiment of the present invention.
Figure 11:
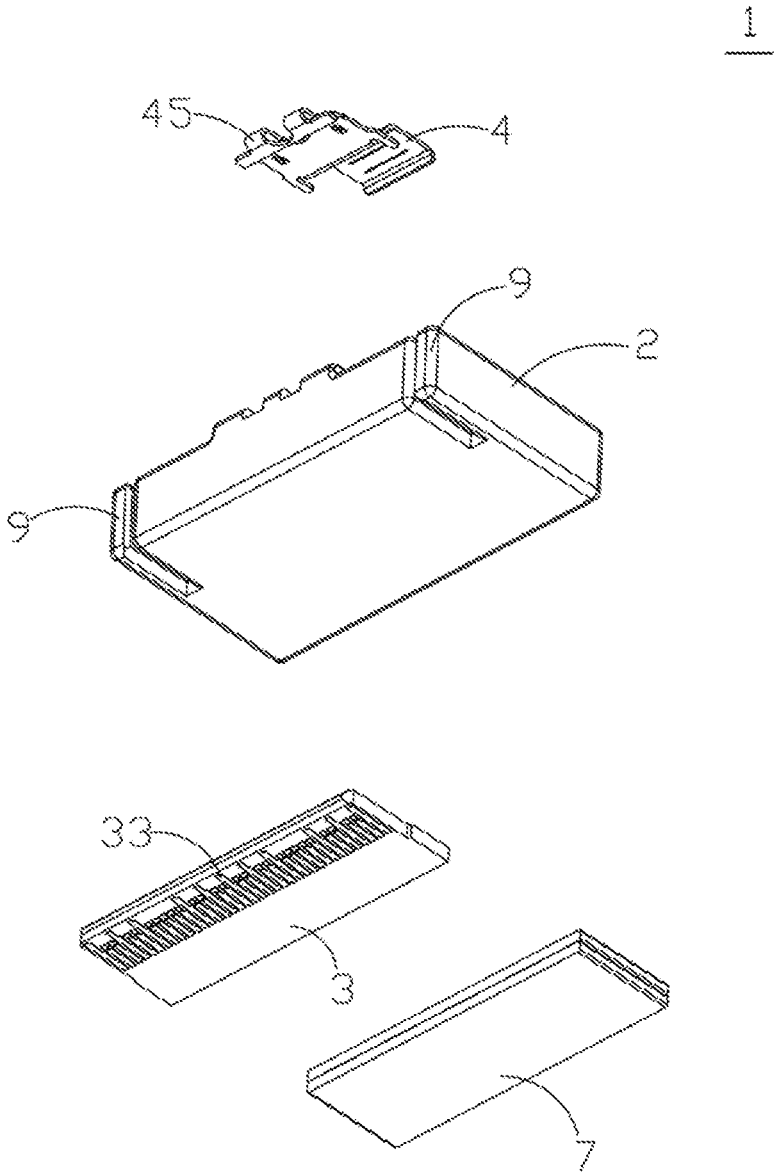
FIG. 11 is a three-dimensional exploded view in the second perspective according to the second embodiment of the present invention.
Figure 12:
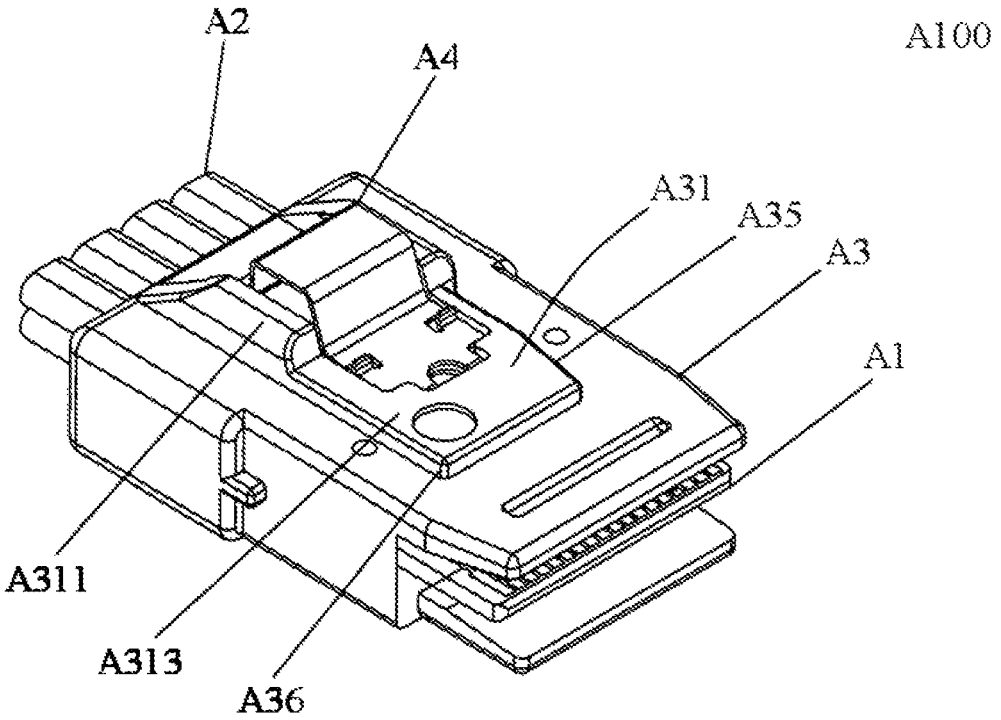
Fig. 12 (PRIOR ART)
FIG. 12 is a prior art figure disclosed in Taiwan Pat. No. M412483.

As shown in FIG. 8 to FIG. 11, in a second embodiment of the present invention, second guide rods 9 may also be formed by broadening opposite sides of the insulating housing 2 of the connector 1 and vertically extending the sides outwardly towards a docking connector (not shown). In particular, as shown in FIG. 9, an end of the insulating housing 2 is connected to the circuit board 3, and the guides 9 extend to align with the end in the present embodiment. In other embodiments, the guides 9 may extend approximately beyond the insulating housing 2 to the circuit board, such as the guides 5 shown in FIG. 5 or 7. The second guide rods 9 are L-shape structures herein. The second guide rods 9 with L-shape structures are disposed symmetrically that they face towards each other in regards of the sides of the insulating housing 2, the disposing location and the shape of the second guide rods 9 may be varied with practical demand, the figures disclosed herein are only a preferred embodiment and not intended to limit the scope of the present invention. Since the second guide rods 9 and the insulating housing 2 are formed in one piece, the stability of the second guide rods 9 on the connector 1 is generally improved.

In comparison with the prior art, by using the guide rods in the connector to match with the docking connector and as an scoop-proof device of two connectors, the guide structures of the guide rods may effectively reduce the error to a minimum. Accordingly, the angle and the offset position generated during the docking phase may be corrected, and the correction may prevent the docking terminals of the docking connector from being damaged and deformed by the excessive angle of the insertion of the circuit board. As a result, two connectors dock with each other more successfully, thus effectively increase the life-span of the connector and make the connector more adaptive to the demands of the majority of users.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A connector, comprising:

an insulating housing;

a circuit board having a front end configured to dock with a docking connector and a back end distal to the front end, a plurality of gold fingers being disposed at the front end and exposed at a surface of the circuit board, the back end being embedded in the insulating housing, the front end extending out of the insulating housing; and a plurality of guides, each of the guides being partially embedded in the insulating housing and parallel to the circuit board, wherein each of the guides is located at one of opposite sides of the insulating housing and extends outwardly towards the docking connector, wherein each of the guides approaches a location of the gold fingers on the circuit board and has an end overlapping a sidewall of the front end extending out of the insulating housing.

2. The connector of claim 1, wherein each of the opposite sides of the insulating housing is disposed with at least one bump extending outwardly, and each of the guides is partially embedded in a side of a corresponding one of the bumps.

3. The connector of claim 1, wherein each of the guides is a rectangular bar made of a metal material.

4. The connector of claim 1, wherein a side of each of the guides adjacent to the circuit board has an unfilled corner.

5. The connector of claim 1, wherein each of the guides is assembled to the insulating housing.

6. A connector, comprising:

an insulating housing;

a circuit board having a front end configured to dock with a docking connector and a back end distal to the front end, a plurality of gold fingers being disposed at the front end and exposed at a surface of the circuit board, the back end being embedded in the insulating housing, the front end extending out of the insulating housing; and a plurality of guides, each of the guides being extended from the insulating housing and parallel to the circuit board, wherein each of the guides is located at one of opposite sides of the insulating housing and extends outwardly towards the docking connector, wherein each of the guides approaches a location of the gold fingers on the circuit board and has an end overlapping a sidewall of the front end extending out of the insulating housing.

7. The connector of claim 6, wherein each of the opposite sides of the insulating housing is disposed with at least one bump extending outwardly, and each of the guides is partially embedded in a side of a corresponding one of the bumps.

8. The connector of claim 6, wherein each of the guides is a rectangular bar made of a metal material.

9. The connector of claim 8, wherein each of the guides is assembled to the insulating housing.

10. The connector of claim 6, wherein a side of each of the guides adjacent to the circuit board has an unfilled corner.

11. The connector of claim 6, wherein each of the guides is formed as a part of the insulating housing and extends towards the docking connector.

12. The connector of claim 11, wherein the guides are inserted and molded in the insulating housing.

13. The connector of claim 11, wherein each of the guides is assembled to the insulating housing.

14. The connector of claim 6, wherein each of the guides has an L-shape structure.

15. A connector, comprising:

an insulating housing;

a circuit board having a front end configured to dock with a docking connector and a back end distal to the front end, a plurality of gold fingers being disposed at the front end and exposed at a surface of the circuit board, the back end being embedded in the insulating housing, the front end extending out of the insulating housing; and a plurality of guides, each of the guides being partially embedded in the insulating housing and parallel to the circuit board, wherein each of the guides is located at one of opposite sides of the insulating housing and extends outwardly towards the docking connector, wherein each of the guides is a rectangular bar made of a metal material.

16. The connector of claim 15, wherein the guides are inserted and molded in the insulating housing.

17. The connector of claim 15, wherein each of the guides is assembled to the insulating housing.

18. The connector of claim 15 wherein each of the guides is located at one of opposite sides of the insulating housing to form a gap therebetween.

* * * * *